United States Patent [19]

Teague, Jr.

[11] Patent Number: 4,750,236

[45] Date of Patent: Jun. 14, 1988

[54] TRACK-TYPE DOOR HOLD-OPEN DEVICE

[75] Inventor: Ralph T. Teague, Jr., Monroe, N.C.

[73] Assignee: Yale Security Inc., Monroe, N.C.

[21] Appl. No.: 186

[22] Filed: Jan. 2, 1987

[51] Int. Cl.[4] ..... E05F 3/00; E05C 17/04; E05C 17/16

[52] U.S. Cl. ..... 16/49; 292/270; 292/278

[58] Field of Search ..... 16/49, 65, 82, 85, DIG. 10; 49/394; 292/272, 273, 277, 270, 274, 275, 278

[56] References Cited

U.S. PATENT DOCUMENTS

| | | | |
|---|---|---|---|
| 2,108,891 | 2/1938 | Johnson | 292/275 |
| 2,277,316 | 3/1942 | Garrison | 292/274 |
| 2,958,089 | 11/1960 | Roehm et al. | 292/275 |
| 3,630,560 | 12/1981 | Atkins | 292/270 |
| 4,286,412 | 9/1981 | Stevens | 292/270 |

*Primary Examiner*—Nicholas P. Godici
*Assistant Examiner*—Edward A. Brown
*Attorney, Agent, or Firm*—Dallett Hoopes

[57] ABSTRACT

A door hold-open device is adapted to work with a conventional single-arm door closer. The device comprises a shoe moving along a track and connected to the closer operating arm. A detent in the form of a wheel is provided in the track which can be lowered through linkages by a solenoid to engage the shoe. Spring pressure on the detent can be adjusted in the field. The detent holds the shoe at one end of the track so that the door is held open. But the door can be forcibly closed causing the shoe to raise the detent, or the solenoid can be deactivated to raise the detent.

12 Claims, 2 Drawing Sheets

TRACK-TYPE DOOR HOLD-OPEN DEVICE

BACKGROUND OF THE INVENTION

1. Field of the Invention

This invention relates to a selectively operable hold-open device for use with a conventional door closer. More specifically, the invention relates to a hold-open device for a swinging door, the device adapted to be made effective by power means such as a solenoid and rendered ineffective permitting the door to close either by deactivation of the same power means or by being overcome by forcible manual closing of the door.

2. Description of the Prior Art

In the prior art there are a number of door holders adapted to be used with the single operating arm of a conventional door closer mounted on a swinging door for the purpose of holding the door open. One holder of this sort is disclosed in the U.S. Pat. No. 4,286,412, which issued Sept. 1, 1981 on an application by William E. Stevens assigned to the parent of my assignee. This invention offers an improvement on that device. Typically, such devices are used in hospitals, for instance, whereby the door may be held open by the device until its power means are deactivated to release the door to permit it to close. Such an arrangement has been used in situations wherein the event of fire, for instance, the door to a patient's room is automatically closed.

SUMMARY OF THE INVENTION

Under the present invention, as in the Stevens patent, a shoe attached to the operating arm of the door closer travels along a track in the device which is mounted on a door frame. The shoe, in its travel approaching the open position of the door, passes a spring detent which automatically holds the shoe from returning. This holds the door open. A release of the shoe can be accomplished by raising the detent. The raising of the detent is either accomplished by a deactivation of the same power means or by a forcible closing pressure on the door.

While the Stevens invention was meritorious, the present invention is an improvement on that Stevens invention. One of the features that the present invention offers is that it provides means for adjusting in the field the downward pressure exerted by the detent. Moreover, the present invention provides a total reorganization of the detent mechanism so that a relatively weak solenoid can selectively activate or deactivate the engagement of the detent which requires great force to overcome.

BRIEF DESCRIPTION OF THE DRAWINGS

Further objects and features of the invention will be apparent from a reading of the attached specification and drawings, all of which disclose a non-limiting form of the invention. In the drawings.

DESCRIPTION OF THE PREFERRED EMBODIMENT

Figure 1:
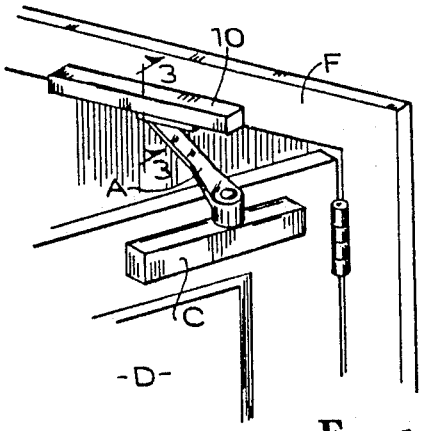
FIG. 1 is a fragmentary perspective view showing a door associated with a holder of the invention. The door in this view is being opened.
Figure 2:
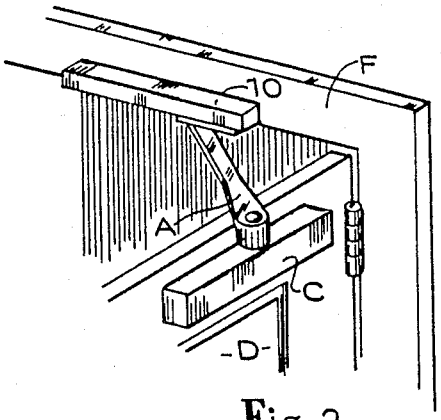
FIG. 2 is a view similar to FIG. 1 but wherein the door is fully opened and being held open by the holder of the invention.

A door hold-open device embodying the invention is generally designated 10 in FIG. 1. It is mounted on the frame F of a door D and to it is attached the arm A of a conventional door closer C.

While the arrangement can be otherwise—that is, with the closer mounted on the frame and the device mounted on the door—the invention is well disclosed in the shown drawings wherein the hold-open device is frame-mounted.

The hold-open device 10 comprises a combined track 12 and housing 14. Preferably this is in the form of an aluminum extrusion having a cross section (FIG. 10) of generally inverted U-shape comprising a top wall 16, sidewalls 18, the opposed inward track flanges 20, and the support web 22.

Slideably mounted for movement along the flanges 20 is the shoe 24. As shown best in FIGS. 8 and 10 the shoe is formed with grooves 26 in its opposite sides which receive the respective flanges. As is customary, the shoe is formed with a central bore 28 which is surrounded by a wheel 30 adapted to receive a pin (not shown) extending upward from the holder end of the arm. Also as is customary, the pin is formed with a groove to receive a forked retainer 32 slideably mounted near the top of the shoe. In practice the pin is inserted in opening 28 and the retainer is slid rightwardly so that its bifurcations fit into the opposite sides respectively of the circumferential groove (not shown) in the arm pin.

On its rightward end the shoe is formed with a simple horizontal web 34 in which is mounted a special hardened rivet 36 having a domed head 38 or nib for reasons which will appear.

Bolted on top of web 22 within the housing 10 is the detent operator housing 40. As shown, the housing 40 is held in position by bolts 41, one of which is shown, extending through web 22. The housing 40 (FIGS. 5 and 6) comprises a bottom wall 42 and sidewalls 44. The sidewalls are slightly recessed as at 46 and receive an inverted U-shaped metal cover 48 (FIG. 7) which snuggly embraces the walls, fitting into the recesses 46 on both sides.

Figure 5:
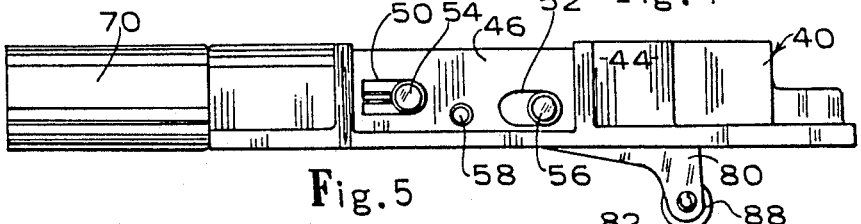
FIG. 5 is an enlarged side view of the detent-activating subassembly.

As shown in FIG. 5, the sidewalls are each formed with a pair of horizontal slots 50 and 52 which receive transverse rollers 54 and 56 for back-and-forth movement in the slots. A pin 58 is fixedly disposed in aligned openings in the two sides intermediate slots 50 and 52.

A latching cam 60 is pivoted intermediate its ends on the pin 58. The cam 60 is formed at its opposite ends with a pair of downwardly facing shoulders 64 and 66 which as shown may engage the upper surface of the rollers 54 and 56, respectively. Preferably the shoulder 64 is inclined upwardly away from pin 58. Adjacent surface 66 is a perpendicular latching surface.

Figure 3:
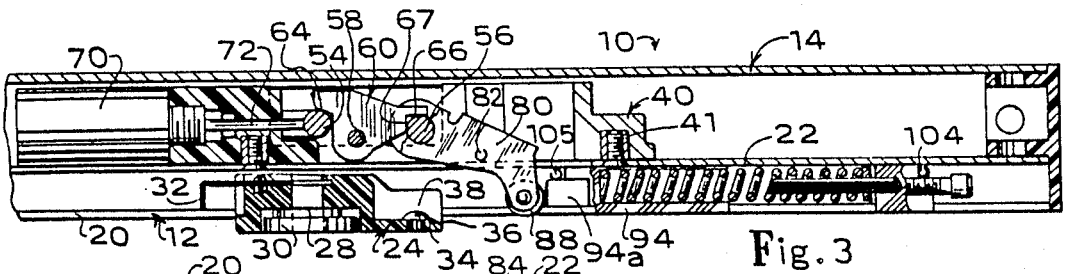
FIG. 3 is a fragmentary sectional view taken on the line 3—3 of FIG. 1.
Figure 4:
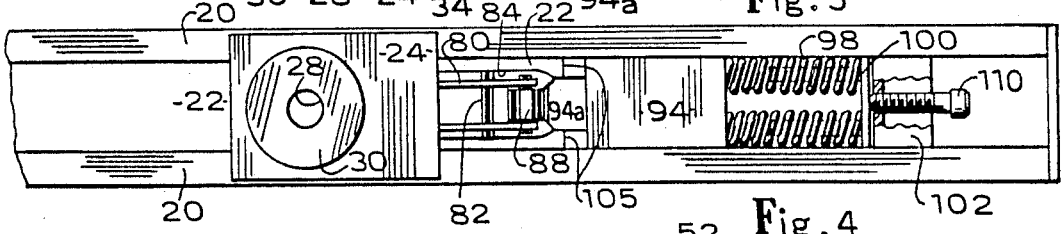
FIG. 4 is a fragmentary bottom plan view.
Figures 7, 8, 9, 10, 11, 12:
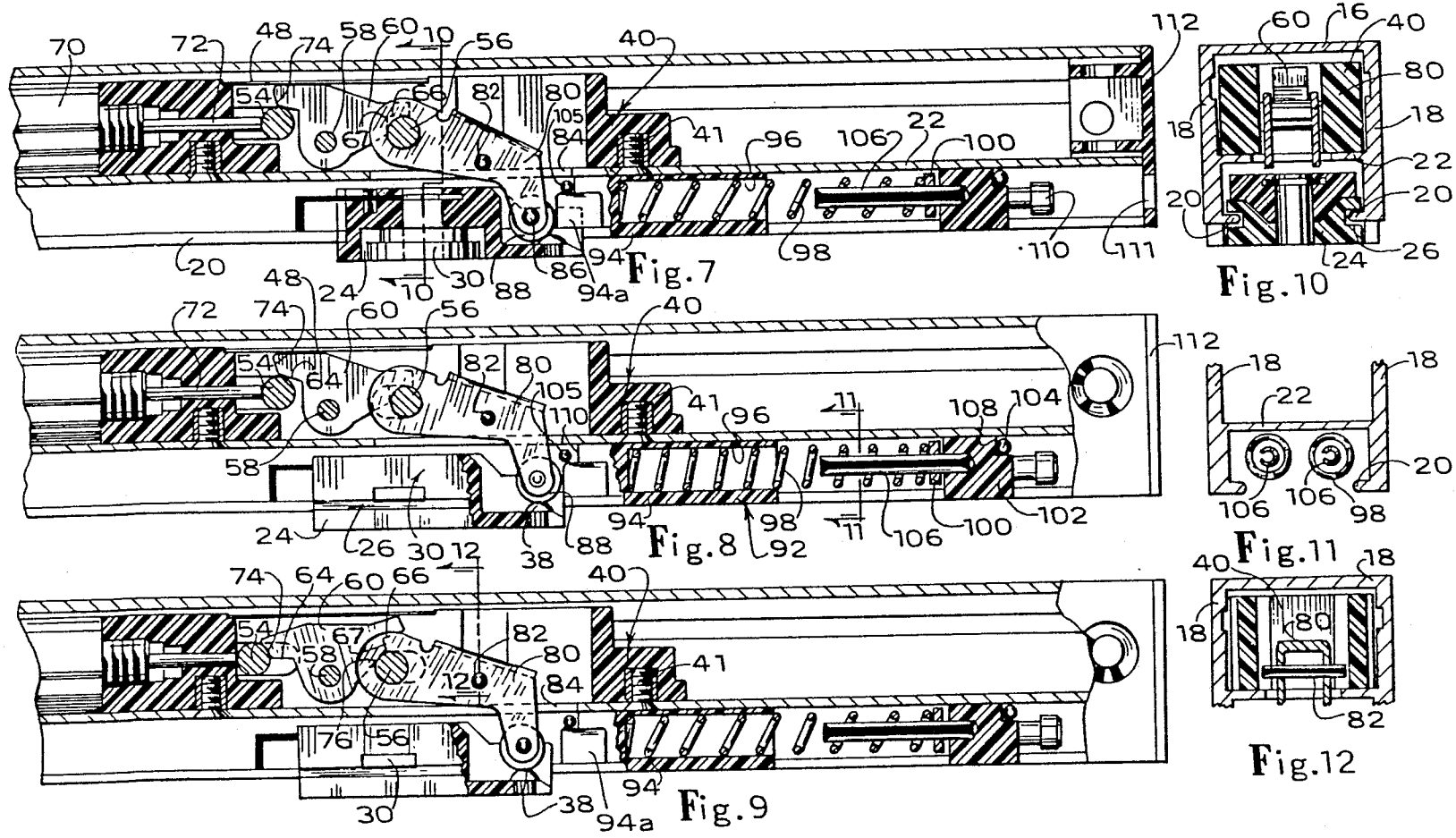
FIG. 7 is an enlarged view similar to FIG. 3 but showing the shoe engaged and held by the detent as when the door is held open.
FIG. 8 is a view similar to FIG. 7 but showing the shoe moving leftward as in a forcible close.
FIG. 9 is a view similar to FIG. 7 but showing the shoe moving leftward, the solenoid shaft having been retracted.
FIG. 10 is a sectional view taken on the line 10—10 of FIG. 7.
FIG. 11 is a fragmentary sectional view taken on the line 11—11 of FIG. 8.
FIG. 12 is a fragmentary sectional view taken on the line 12—12 of FIG. 9.

A solenoid 70 is provided having a drive shaft 72 which when extended, as when activated electrically, urges the roller 54 rightwardly under shoulder 64. The movement of the roller 54 to the rightward position as shown in FIG. 3 is facilitated by a partially inclined surface 74 above shoulder 64 (FIG. 9). The roller 56 in its slot 52 is, during the extension of the shaft 72, also urged in a rightward direction by virtue of the incline 76 on the opposite side of the cam 60. On its rightward distal end, the latching cam is formed with a latching notch comprising perpendicular sufaces: a downward shoulder 66 and an outward vertical or perpendicular latching surface 67. Because the cover 48 is in place, the rollers are prevented from endwise movement out of the side walls 44.

A detent wheel arm 80 (FIGS. 3, 7–9) is provided. It is of generally inverted U-shape in cross section (FIG. 12). Intermediate its ends the side walls of the arm are apertured and receive a fixed pin 82 the outer ends of which normally rest on the web 22. The web is apertured as at 84 and permits passage of the wheel end of the arm 80. Mounted between the side walls at the lower end of the arm is a spindle 86 on which rides the detent wheel 88, which is disposed down in the area traversed by the shoe 24 (FIG. 3).

The opposite end of the arm includes extensions of the same parallel side walls of the U-shape structure and is apertured to receive the roller 56.

Figure 6:
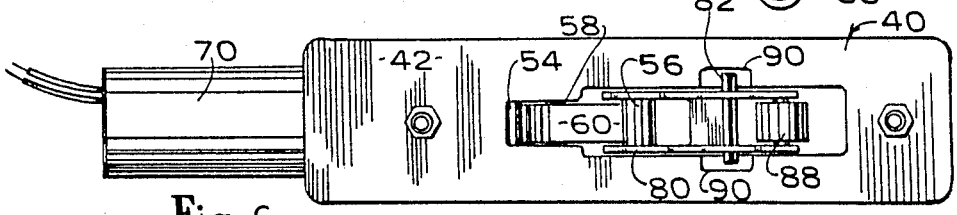
FIG. 6 is a bottom view of the subassembly.

As shown best in FIG. 6, the bottom wall of the housing 40 is cut out to permit passage of the arm 80 including the detent wheel 88, and the cut-out has lateral enlargements 90 to permit passage of the ends of pin 82.

Completing the assembly is the pressure means 92 which works against the wheel 88 to keep it urged downwardly. Pressure means 92 comprises the block 94 which is formed with a pair of spring-receiving bores 96 which receive a pair of springs 98. The springs 98 are compressed between their seats in block 94 and the bearing plate 100. Bearing plate 100 is supported adjacent an end block 102. Block 94 has a working head **94*a***.

Both the spring block 94 and end block 102 are slideably supported within the cavity (FIG. 11) between the web 22 and the flanges 20. The cavity is traversed by stop pins 104 and 105 (FIG. 8) mounted in side walls 18 and which are engaged in notches 108 and 110 on the block 102 and the spring block 94 respectively, limiting their outward movement. Blocks 94 and 102 are captured in the area defined by web 22 side walls 18 and flanges 20.

For stability, guides 106 are fixed in the end block 102 and extend through apertures in the bearing plate 100 and into the respective springs 98. An adjusting screw 110 (FIG. 7) extends through the end block 102 and engages the rightward surface of the bearing plate 100 to adjust the pressure on the springs 98. Access to the head of the adjusting screw 108 may be had through an opening 111 in the end wall 112 of the device.

In operation, with the solenoid activated and its shaft 72 extended, as is the normal condition, the latching cam 60 and the roller 80 are in the position shown in FIGS. 3 and 7. In this position, the latching surface 76 holds roller 56 in its rightward position and the detent 88 is urged down by contact with head **94*a* of block 94. In this position, the detent intercepts the path of the domed head 38 of rivet 36. Thus, when the door is opening (FIG. 3) the shoe 24 moves rightwardly, and as the head or nib 38 engages detent wheel 88, it urges the latter upward against the bias of the springs 98 until the dome is on the rightward side of wheel 88 and that roller has returned to the position shown in FIG. 7. It will be understood that during this process the block 94 is moved rightward, away from the pin 105** by which it is normally held from leftward movement.

With the wheel down and head 38 rightward of the wheel, the door is in its most usual condition, namely, held open. From this position the door can be closed in one of two ways. First, it can be forcibly closed by manually pushing against the door adjacent its handle (not shown) to urge the shoe 24 leftward so that the dome (FIG. 8) raises the detent against the bias of the springs 98. This operation is the opposite of the opening procedure wherein the detent wheel is urged upward as the shoe moves rightward.

The second manner in which the door may be closed is for the solenoid 70 to be de-energized as would be done from a remote electrical control station—that is, the nurses' desk in a hospital, for instance—or by a smoke sensor which may be incorporated into the device but which is not part of the invention. Deactivating of the solenoid 70 causes retraction of the shaft 72 (FIG. 9) so that the roller 54 retreats, permitting the latching cam to rotate counterclockwise (FIG. 9). This allows the roller 56 to move leftwardly as it slides against incline 76 and permits the domed head 38 to move the detent wheel 88 upward under no resistance at all. With the shoe moving leftward (FIG. 9), as it is biased to do by the action of the closer C, the door assumes a closed condition.

As stated earlier, the subsequent activation of solenoid 70 causes the shaft 72 to move rightward, and drives the roller down the incline 74 to engage shoulder 64. Simultaneously, incline 76 urges roller 56 rightward to establish a latched condition as it nestles against shoulder 66 and presses against its perpendicular latching surface 67 (FIGS. 3 and 7). With the holder in this condition the door is ready to be opened and held opened as described above in connection with FIGS. 3 and 7.

The invention may taken many other forms, and changes in dimension, shape and arrangement of parts are possible. Thus, while the invention has been described in a preferred embodiment, it should be understood that the invention is not limited to the specific features of the preferred embodiment but is, instead, limited only by the boundaries of the following claim language and equivalents.

I claim:

1. A selectively operable hold-open device for use with a conventional single-arm door closer, mounted on a swinging door comprising:

a. track means;

b. shoe means adapted to be connected to the distal end of the door closer arm and to move along the track means, the shoe means having an upward nib;

c. a latching cam pivoted intermediate its ends on a pin transverse to the track means, the cam having an incline adjacent one end and an overhang on the other end presenting an outwardly and downwardly facing latching notch;

d. a first roller at the one end adapted to move toward and away from the cam and being supported to move against the incline to pivot the cam;

e. power means to move the first roller against the incline;

f. a detent arm mounted adjacent the latching cam and in line therewith along the track and extending down away from the cam;

g. a second roller pivotally mounting the upper end of said detent arm and adapted to move toward and away from the cam and to butt against said latching notch when the latching cam is pivoted upon activation of the power means;

h. detent means on the opposite end of the detent arm from the second roller;

i. retaining means keeping said opposite end of the detent arm from dropping toward the track beyond a certain distance;

j. horizontally disposed compression spring means mounted adjacent the track in compression against the detent means;

k. stop means limiting the movement of the end of the spring means toward the detent means, whereby the detent means is in the path of the nib on the shoe when the power means is activated and the roller is against the latching notch on the cam and the detent means yields upwardly against the lateral force of the spring means when the door is brought to the fully open position or forcibly moved toward a more closed position from the open position, and the door is permitted to move freely from the open position when the detent means moves up as a result of the deactivation of the power means.

2. A door hold-open device as claimed in claim 1 wherein the detent means is a wheel adapted to engage both the nib and the spring means.

3. A door hold-open device as claimed in claim 1 wherein the latching notch comprises perpendicular surfaces.

4. A door hold-open device as claimed in claim 1 wherein the detent arm is of U-shaped cross-section.

5. A door hold-open device as claimed in claim 1 wherein the latching cam, the rollers and the detent arm are all mounted in a housing having parallel walls and the rollers are disposed in horizontal slots in the side walls of the housing.

6. A door hold-open device as claimed in claim 1 wherein the nib is the hardened domed head of a rivet mounted in the shoe.

7. A door hold-open device as claimed in claim 1 in which the track is part of an extruded elongate body.

8. A door hold-open device as claimed in claim 7 in which the track comprises inwardly facing aligned flanges in the body.

9. A door hold-open device as claimed in claim 8 in which the body has a horizontal web above the flanges and the web has mounted on it a housing enclosing the rollers, the latching cam and the detent arm, and the web is apertured to permit passage of the detent arm downward into the path of the nib of the shoe as the shoe slides on the track.

10. A door hold-open device as claimed in claim 9 wherein the housing also has mounted on it the power means.

11. A door hold-open device as claimed in claim 1 wherein the spring means is adjustable so that the force exerted by the spring on the detent may be changed.

12. A door hold-open device as claimed in claim 1 wherein wherein the spring means comprises at least one axial spring having an axis parallel to the track means.

* * * * *